US005497648A

United States Patent [19]

Crossman

[11] Patent Number: 5,497,648

[45] Date of Patent: Mar. 12, 1996

[54] DOLLY BLOCK FOR USE IN STRAIGHTENING, SMOOTHING AND COLD SHRINKING OF SHEET METAL PANELS

[76] Inventor: Roy D. Crossman, 26789 NW. St. Helens Rd., Scappoose, Oreg. 97056

[21] Appl. No.: 441,056

[22] Filed: May 15, 1995

[51] Int. Cl.[6] ..... B21B 25/00

[52] U.S. Cl. ..... 72/465; 72/477; 72/705

[58] Field of Search ..... 72/465, 476, 477, 72/705

[56] References Cited

U.S. PATENT DOCUMENTS

| | | | |
|---|---|---|---|
| 1,506,578 | 7/1920 | Grandahl . | |
| 2,314,617 | 3/1943 | Gambino | 72/465 |
| 2,340,950 | 3/1940 | Ferguson . | |
| 2,357,726 | 9/1944 | Carter | 72/477 |
| 2,416,916 | 3/1947 | Ferguson | 72/465 |
| 2,518,073 | 8/1950 | Sargent . | |
| 2,786,375 | 3/1957 | Johnson . | |
| 4,677,840 | 7/1987 | Kellogg et al. . | |

*Primary Examiner*—David Jones
*Attorney, Agent, or Firm*—Eugene M. Eckelman

[57] ABSTRACT

A body member of polyurethane plastic has flat bottom, side and end walls and a convex top wall. The body member is of equal width and fully encloses a core of metal having a flat top, bottom side and end walls. The core is uniform in thickness throughout its length such that the thickness of plastic of the body member will vary between the top surface of the core and the convex top wall of the body member. The core is also closer to one side of the body member than to the other to provide varying cushioning hardness. Further, the bottom surface of the block is provided with a plurality of dimples for distributing and absorbing energy in a cold shrinkage function.

12 Claims, 1 Drawing Sheet

DOLLY BLOCK FOR USE IN STRAIGHTENING, SMOOTHING AND COLD SHRINKING OF SHEET METAL PANELS

BACKGROUND OF THE INVENTION

This invention relates to new and useful improvements in a dolly block.

Modern day automobiles are being produced with much thinner sheet metal body parts than they were in the past. Such thinner body parts comprise, for example, door skins, quarter panels, hoods, roofs, etc. These thin sheet metal parts require considerable finesse when being straightened or smoothed by pick hammer blows in combination with an anvil or dolly block. That is, unless the dolly block can form a desired anvil surface or in other words can properly distribute hammer forces, including for cold shrinking, a smooth, even skin surface is difficult or impossible to produce.

Prior dolly blocks have been proposed for use as anvils. The older types of blocks were constructed from metal, including the anvil surface thereof. Such blocks are shown in U.S. Pat. Nos. 1,506,578, 2,340,950, 2,518,073, and 2,786,375. These metal anvil surfaces will not perform satisfactorily on thin type metal auto body parts because the necessary finesse of impact energy, such as straightening, smoothing, cold shrinking, etc., cannot be achieved. A rubber covered dolly block has been proposed to prevent marring of thin gauge metal door skins and also to be more comfortable and convenient to use than iron dollys. Such a dolly block is shown by U.S. Pat. No. 4,677,840. This block has a metallic core of embedded cast iron which is shaped generally to the external configuration of the overall dolly block. The covering of rubber on the top surface of the core as well as on the sides and ends is equal in thickness but the bottom covering is twice as thick as on the rest of the block. One disadvantage of this prior block is that the rubber covering around the cast iron core does not have a variety of thicknesses to accomplish the necessary finesse of straightening and smoothing thin sheet metal parts such as door skins. Another disadvantage of this prior tool is that the inherent qualities of rubber limit the useful life of the block since rubber disintegrates after prolonged hard usage. Further, no provision is made to allow the tool to be used for cold shrinking.

SUMMARY OF THE INVENTION

According to the invention, a primary object is to provide a dolly block that is designed as one of its main functions to carry out cold shrinking.

A further object is to provide a substantial improvement over prior dolly blocks in that the invention includes a cast iron core and a substantially indestructible plastic covering and also includes an improved overall shape and varying covering thicknesses of plastic on the surfaces thereof that allow the block to be customized in use to different skin shapes and requirements for straightening, smoothing, or installing the skins.

Another object is to provide a dolly block of the type described that includes a plurality of dimples in one surface that distribute and absorb energy in an improved manner for accomplishing said cold shrinking.

In carrying out the objects of the invention, the dolly block includes a body member having flat bottom, side and end walls and a convex top wall. The flat bottom surface includes a plurality of dimples which distribute and absorb energy from a pick hammer for accomplishing cold shrinking. The body member is of equal width and molded of an indestructible plastic having a hardness capable of long life for use as an anvil but of a necessary and improved cushioning resilience to absorb the energy from a hammer. The plastic body member encloses a core of metal or other heavy material which also is flat on the bottom, side and end walls and in addition is flat on the top. The core is uniform thickness throughout its length and thus in combination with the convex top wall surface presents a varying cushioning distance from the convex surface and thus a varying cushioning hardness. The core is offset closer to one side of the body member than to the other side to also provide varying cushioning hardness.

The invention will be better understood and additional objects and advantages will become apparent from the following description taken in connection with the accompanying drawing.

DETAILED DESCRIPTION OF A PREFERRED EMBODIMENT

Figure 1:
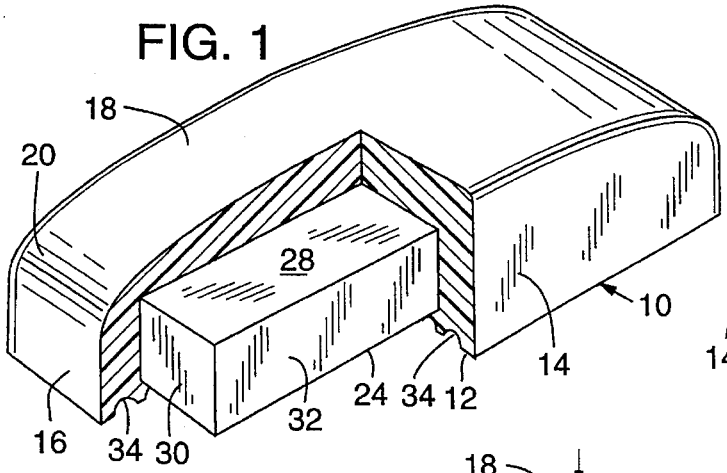
FIG. 1 is a perspective view of the dolly block of the invention, a portion of the block being broken away to show the inner core.
Figure 4:
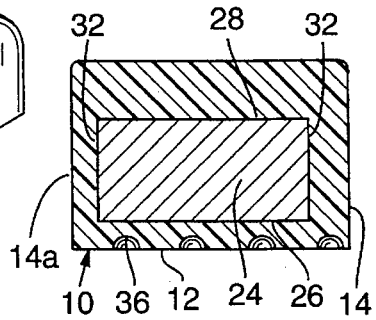
FIG. 4 is a cross sectional view taken on the line 4—4 of FIG. 3.

The dolly block 10 of the instant invention comprises a unitary plastic body member of a size that can be held firmly in a worker's hand. The block has a planar bottom surface 12, vertical planar opposite side wall surfaces 14 and **14*a*, planar end wall surfaces 16, and a convexly shaped top wall surface 18. The top wall 18 is of substantially uniform radius and leads into end walls 16 at reduced radius rounded edges 20. The convex top surface and the vertical side wall surfaces of the block, as well as the rounded edges 20**, provide a tool that is easily held in a worker's hand and manipulated as required in its use as an anvil.

Embedded totally within the plastic block 10 is a heavy core 24, such as iron or steel. The core includes a planar bottom surface 26, a planar top surface 28, a pair of vertical planar end walls 30 and vertical planar side walls 32. By such disposition of its wall surfaces, the core is of rectangular shape as viewed from the sides, from the ends and from the top.

Figure 2:
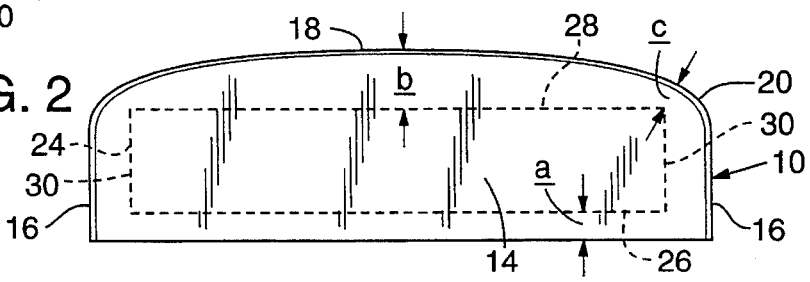
FIG. 2 is a side elevational view of the block.
Figure 3:
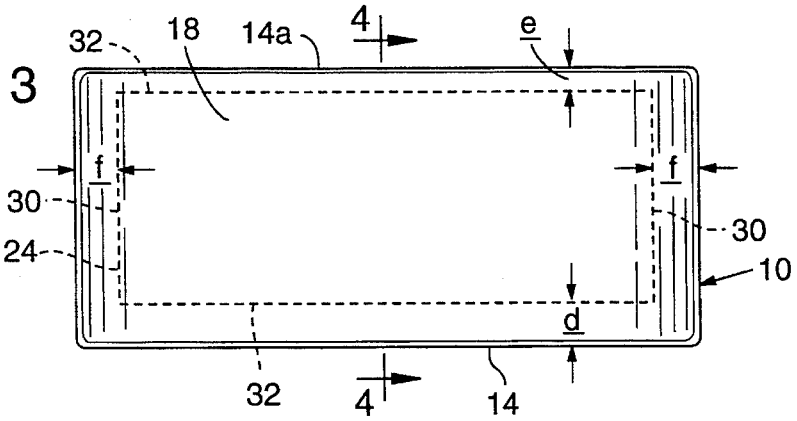
FIG. 3 is a top plan view.

With particular reference to FIG. 3, the core 24 is closer to side edge 14 of the block than to the opposite side edge **14*a*, namely, about one-half as far. The bottom surface 26 of the core is spaced from the bottom surface 12 of the body member a distance approximately equal to the side spacing of the block from side 14 of the block. The top of the core 24 varies in its spacing from the top surface 18 of the block because of the convex curvature and curved surfaces 20 of the top surface 18, best seen in FIG. 2**.

As an illustration of the dimensional relationship of the block and the core, the block has an overall length of approximately 150 mm and a width of approximately 65 mm. Its thickness or height at a midpoint between the ends is approximately 40 mm. The core 24 has a length of approximately 130 mm and a width of approximately 50 mm. Its thickness or height is approximately 25 mm. The spacing between the bottom surface of the core and the bottom surface of the block, designated by a in FIG. 2, is approximately 5 mm and the spacing of its top surface at a midpoint between the ends, designated by b is approximately 13 mm to the top of the block. The spacing of the top end edges of the core radially outwardly to the rounded corners 20, designated by c, is approximately 6 mm. The spacing of the core from surface 14 is approximately 10 mm, designated by d, and the spacing of the core from surface 14*a* is approximately 5 mm, designated by e. The spacing of the core from each end surface 16 is approximately the same as the spacing at the sides from surface 14, designated by f. All of such particular spacing and approximate dimensions are important to the function of the dolly block, as will be described in greater detail hereinafter.

Figure 5:
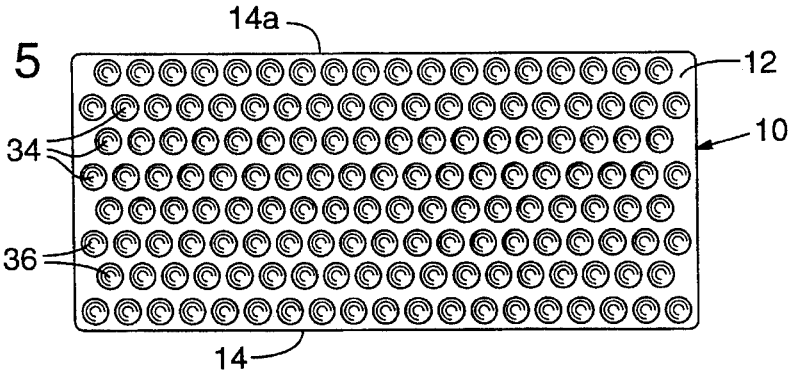
FIG. 5 is a bottom plan view.

With particular reference to FIG. 5, the entire bottom surface of the block has closely spaced round dimples 34 approximately 2 mm deep and approximately 6 mm in diameter. The dimples are provided in staggered rows 36 and are used primarily in functions of cold shrinking, to be described.

The plastic for the body portion 10 comprises a thermosetting castable polyurethane having a hardness of approximately 70 shore A durometer identified by PNX A70BL1061P in the trade. Such castable plastic has the desired combination of resilience and hardness for the intended purpose herein. The block is used as an anvil surface for straightening, smoothing, installing or other functions of operation on thin sheet metal. skins. The iron core provides the inertia from a hammer force and absorbs the energy imparted by a hammer as impact occurs. Various energy absorption is desired for the anvil surface and such varying control is achieved by using the surface of this anvil which is of selected thickness. For example, where a maximum or larger inertia from the core is desired, the workman can use the side 14 of the block, namely, the side that is closest to the side 32 of the core. On the other hand, if less inertia is desired from the core, the workman can use the other side 14*a* of the block. The top of the block provides varying inertia thicknesses in view of its convex surface 18. In addition, the area of the block at the corners 20 provide a greater inertial energy in view of the closer spacing between the upper end edges of the core to the outer surface of the block at these points.

In other words, the block can be manipulated to provide the desired anvil effect which in turn is controlled by the selection of the anvil surface at desired thickness of plastic relative to the core 24 in relation to the hammer impact point. Also, the convex top surface 18 and the rounded corners 20 provide an anvil surface for working on curved metal portions.

The dimpled bottom surface 12 of the block provides a finishing surface for great finesse in working with thin sheet metal and particularly for cold shrinking by the pick end of a pick hammer. In such operation, the dimples 34 provide a soft or cushioning impact from the hammer and eliminate any appreciable recoil from the anvil. Cold shrinking is accomplished without heating the metal.

As stated, the present invention is particularly useful for renewing dented auto parts and the like but can be used for other purposes that may be appropriate. The polyurethane plastic is rugged and practically indestructible and amounts to a substantial improvement over a rubber coating.

It is to be understood that the forms of my invention herein shown and described are to be taken as preferred examples of the same and that various changes in the shape, size and arrangement of parts may be resorted to without departing from the spirit of my invention, or the scope of the subjoined claims:

Having thus described my invention, I claim:

1. A block for serving as an anvil in the process of straightening, smoothing, etc. of thin sheet metal, comprising:

a body member having flat bottom, side and end walls and a convex top wall, said body member being of equal width throughout its length, said body member being molded of a plastic having a hardness capable of serving as an anvil but of a cushioning resilience to absorb energy from a hammer that uses the body member as an anvil, and a core of metal or heavy material embedded fully in said body member, said core having a flat top, bottom, side and end walls, said core having a uniform thickness throughout its length whereby the thickness of plastic of said body member will vary between the top surface of said core and the convex top surface of said body member and provide varying cushioning hardness.

2. The dolly block of claim 1 wherein corner portions between the end walls and the top wall of the body member are rounded to decrease the thickness of plastic at said corner portions and increase the cushioning hardness thereof.

3. The dolly block of claim 1 wherein said core has a uniform width throughout its length but is offset closer to one side of said body member than to the other side.

4. The dolly block of claim 1 wherein said flat bottom wall includes a plurality of dimples for distributing and further absorbing energy from a hammer.

5. The dolly block of claim 1 wherein corner portions between the end walls and the top wall of the body member are rounded to decrease the thickness of plastic at said corner portions and increase the cushioning hardness thereof, said core having a uniform width throughout its length but is offset closer to one side of said body member than to the other side.

6. The dolly block of claim 1 wherein corner portions between the end walls and the top wall of the body member are rounded to decrease the thickness of plastic and the cushioning hardness thereof, said core having a uniform width throughout its length but is offset closer to one side of said body member than to the other side, said flat bottom wall including a plurality of dimples for distributing and further absorbing energy from a hammer.

7. A dolly block for serving as an anvil in the process of straightening, smoothing, etc. a thin sheet metal, comprising:

a body member having top, bottom, side and end walls, said body member being of equal width throughout its length, said body member being molded of a plastic having a hardness capable of serving as an anvil but of a cushioning resilience to absorb the energy from a hammer that uses the body member as an anvil, and a core of metal or heavy material embedded fully in said body member, said core having top, bottom, side and end walls, said core having a uniform width throughout its length but is offset closer to one side of said body member than to the other side.

8. The dolly block of claim 7 wherein said top wall of said body member is convex in configuration and said core is of uniform thickness throughout its length whereby the thickness of plastic of said body member will vary between the top surface of said core and the convex top surface of said body member and provide varying cushioning hardness.

9. The dolly block of claim 7 wherein said body member is approximately 65 mm in width and said core is approximately 50 mm in width, said core member being spaced approximately 10 mm from one side of said body member and approximately 5 mm from the other side of said body member.

10. The dolly block of claim 7 wherein said core has a uniform thickness of approximately 25 mm throughout its length and the bottom thereof is spaced approximately 5 mm from the bottom of the body member.

11. The dolly block of claim 10 wherein said body member is approximately 65 mm in width and said core is approximately 50 mm in width, said core member being spaced approximately 10 mm from one side of said body member and approximately 5 mm from the other side of said body member, said core having a uniform thickness of approximately 25 mm throughout its length and the bottom thereof is spaced approximately 4 mm from the bottom of the body member.

12. A block for serving as an anvil in the process of straightening, smoothing, etc. of thin sheet metal comprising:

a body member having flat bottom, side and end walls, said body member being of equal width throughout its length, said body member being molded of a plastic having a hardness capable of serving as an anvil but of a cushioning resilience to absorb energy from a hammer that uses the body member as an anvil, and a core of metal or heavy material embedded fully in said body member, said flat bottom wall including a plurality of dimples therein for distributing and further absorbing energy from a hammer for cold shrinking of the metal.

* * * * *